United States Patent [19]

Swanson

[11] 4,195,952

[45] Apr. 1, 1980

[54] MEANS FOR ANCHORING TO ROCK

[76] Inventor: Roger I. Swanson, 114 Glenwood Way, Butler, Pa. 16001

[21] Appl. No.: 890,234

[22] Filed: Mar. 27, 1978

[51] Int. Cl.[2] ..... F16B 13/10; E21D 20/00; E21D 21/00

[52] U.S. Cl. ..... 405/259; 85/1 C; 85/76

[58] Field of Search ..... 85/63, 66, 75, 76, 83, 85/84, 85, 1 C, 10 F; 61/45 B; 405/259

[56] References Cited

U.S. PATENT DOCUMENTS

| | | | |
|---|---|---|---|
| 1,304,885 | 5/1919 | Kennedy | 85/85 |
| 1,997,513 | 4/1935 | Escare | 85/83 |
| 2,545,752 | 3/1951 | Singleton | 85/76 |
| 2,707,897 | 5/1955 | Beeson | 85/83 |
| 2,870,666 | 1/1959 | Dempsey | 85/76 X |
| 3,115,056 | 12/1963 | Teeple | 85/76 |
| 3,244,625 | 4/1966 | Silwones | 85/1 C X |
| 3,250,170 | 5/1966 | Siegel | 85/76 |
| 3,324,756 | 6/1967 | Williams | 85/75 |
| 3,385,155 | 5/1968 | Michell | 85/76 X |
| 3,620,120 | 11/1971 | Warner | 85/76 |

FOREIGN PATENT DOCUMENTS

| | | | |
|---|---|---|---|
| 2311214 | 12/1976 | France | 85/1 C |
| 1149944 | 4/1969 | United Kingdom | 85/1 C |

*Primary Examiner*—Thomas J. Holko

*Attorney, Agent, or Firm*—Price, Heneveld, Huizenga & Cooper

[57] ABSTRACT

An improved device for anchoring mine roofs utilizing bolts prestressed to place them under high tension loading is disclosed. The bolt is secured by an anchor consisting of an expandable shell and an expander nut with the nut being movable lengthwise of the hole by turning the bolt. The surfaces of the anchor which engage the surfaces of the hole in which it is installed are coated with sand bonded thereto by a thin coat of a suitable adhesive. By the use of a polywax material to lubricate the threading of the bolt and the camming surfaces of the expander nut, very high lateral expansion forces are generated to press the sand coated surfaces of the anchor against the rock walls creating a high tension load supporting engagement between the anchor and the rock matrix.

11 Claims, 11 Drawing Figures

MEANS FOR ANCHORING TO ROCK

BACKGROUND OF THE INVENTION

For many years, mine roofs were supported by shoring. In more recent times, some of the shoring has been replaced by an anchoring system consisting of bolts which extend upwardly in the ceiling into the overlying rock to tie the surface rock of the ceiling to the rock above to prevent separation and fall. This system has proved to be very desirable. However, the equipment used as the means of tying the surface ceiling rock to the rock above has not been able to develop its full potential, nor has it been possible to install this equipment in such a manner that the true capability of the equipment, as read by the installing instruments, could be accurately determined. Thus, as a result of false readings, some of these supports have failed. In other cases, the full capabilities of the support elements could not be attained, requiring the use of additional supports, thus involving additional labor and expense.

In the conventional system, a hole is bored into the rock forming the stope ceiling to a depth of three or more feet and preferably into a rock layer having a good, solid structure.

Into this, a bolt or rod is inserted with an anchor on its inner end which is pushed up to a point near or at the blind end of the hole and there expanded or bonded to the surrounding rock walls of the opening. There are several conventional practices for anchoring the rock matrix. One such conventional practice is the use of an anchor with wedge-like ridges projecting outwardly from the general surface of the anchor. These are expanded outwardly to bite into the surrounding rock wall structure when the anchor is expanded. Such an arrangement is disclosed in U.S. Pat. No. 2,952,129, entitled "MINE ROOF BOLT INSTALLATION," issued Sept. 13, 1960 to J. B. Dempsey. In some cases, in addition to these ridges, a resin bond is also provided. This is also disclosed in said U.S. Pat. No. 2,952,129. The epoxy resins are extensively used for this purpose. The resin forms a bond with the rock walls. A third system relies entirely upon the use of a bonding medium such as an epoxy to effect a bond between the rock and the anchor. Such an arrangement is disclosed in U.S. Pat. No. 3,108,443, entitled "METHOD OF FIXING ANCHOR BOLTS IN THE DRILL HOLES" issued Oct. 29, 1963 to F. Schuermann et al.

These particular arrangements have not been entirely satisfactory. The use of the ridges actually reduces the area of frictional bearing between the anchor and the rock in the case of hard, dense rock. Thus, the load supporting capacity of the system is reduced. In the case of soft rock, frequently excessive penetration of the teeth of the anchor resulting in an unsatisfactory anchor. Further, with conventional anchor designs, only a limited portion of the anchor actually contacts the rock, further reducing anchor holding power. In either case, the anchor is incapable of developing a support capacity equal to that of which the bolt is capable and in many cases the support is further reduced by creep along the rock walls.

Anchoring entirely by use of a resin bond, even that injected under pressure, has not proved suitable for providing an anchor of adequate supporting capacity. Over a period of time, the resins have a tendency to shrink and thus pull away from the rock wall, loosening the bond. The resin with an inorganic filler such as glass fibers, quartz powder or quartz sand to prevent shrinkage, as disclosed by F. Schuermann et al. in U.S. Pat. No. 3,108,443, has not proven to be a solution.

Further, due to creep in the metal and in the case of the resin bond, due to either improper bonding with the walls of the hole or to an inadequate area of bond as well as shrinkage, the devices, over a period of time, may loosen, thus releasing the ceiling rock, creating a dangerous situation. It has been attempted to overcome this problem in the case of the resin bonding systems by increasing the length of the hole in which the bond is applied. That is an unsatisfactory solution because it does not confine the bond to the deep, structurally sound rock. If a substantial portion of the rod is embedded in the resin, prestressing becomes impossible. Further, the cost of the resins is such as to make this approach excessive in cost.

Another problem has been that of determining whether a proper load has been applied to the bolt to adequately support the ceiling rock of the mine. If the bolt is not tensioned to a point where it is applying substantial upward pressure to the ceiling rock, the ceiling rock is not being adequately supported. The standard method for determining the amount of support provided by the bolt is by applying a torque wrench to the bolt to measure the amount of torque required to turn the bolt. The amount of torque required is extrapolated into tension loading applied to the bolt. It has been discovered that this method of determining tension load often provides a false reading and, further, the method itself prevents the bolt from being tensioned substantially to its elastic limit. The difficulty arises from the fact that a substantial proportion of the torque values are generated as a result of frictional forces acting between the bolt head and the bearing plate and also between the threads on the bolt and the threads on the nut into which it is being tightened and, as the loads increase, there begins to be surface failure of the metals resulting in galling. Once the galling process starts, the torque required to continue to tension the bolt rises sharply, thus falsely indicating the degree of tension applied to the bolt.

When the threads lock-up in tightening, the bolt will have a combined stress that will cause the bolt to yield in torsion even though it is only tensioned to about 60% of its tensil yield.

BRIEF DESCRIPTION OF THE INVENTION

It has been discovered that the load supporting capacity of the anchors for mine roof support bolts can be increased manyfold by applying sand at the interface boundary between the anchor and the rock, In fact, it has been discovered that by coating the anchor with a thin layer of sand bonded to the anchor by a suitable resin, an effective anchor can be attained both in very dense rock and in basically soft rock. Further, this can be accomplished with a relatively small area of rock-to-anchor bearing as compared with the areas of bonding contact which have been considered necessary in prior art devices and which, in the case of prior art devices, have often proved to be unreliable.

I have also developed an anchor construction effecting much higher laterally acting forces and providing a means of expansion which positively forces a substantial proportion of the outer surface of the anchor means into tight and positive engagement with the walls of the opening, thus providing a firm and positive bond between the two. In addition, I have discovered that by application of a coating of a polywax to the threads by which the bolt shifts the camming means to force the anchor out into engagement with the walls of the hole, the resistance to turning of the bolt is materially reduced, thus permitting the torque load applied to the bolt to be applied to the bolt as tension rather than to be required to overcome frictional resistance to the turning of the bolt. This also reduces or substantially eliminates galling, further translating torque loading into tension applied to the bolt. I have also found that by application of the polywax to the camming surfaces by which the sides of the anchor member are forced outwardly against the walls of the opening, a substantially greater proportion of the tension load applied to the rod is translated into force acting outwardly of the anchor, rather than being absorbed by frictional resistance as the camming surfaces of the anchor are moved with respect to each other.

DESCRIPTION OF THE PREFERRED EMBODIMENT

Figure 1:
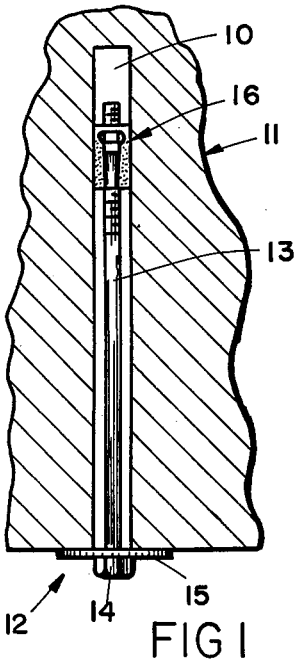
FIG. 1 is a side elevation, sectional view of the invention installed in an opening.
Figure 6:
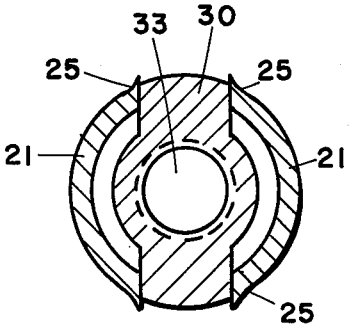
FIG. 6 is a sectional view taken along the plane VI—VI of FIG. 4.

FIG. 1 illustrates the general environment of the primary use of this invention. In this figure, an opening 10 has been drilled in a rock matrix 11. Because of the nature of the tools used to make the hole, it is generally circular in cross section. A mine roof support device 12 embodying this invention has been installed in the opening 10. The device consists of a rod 13 having a head 14 on its outer end. The head 14 bears on a suitable washer-like bearing plate 15. Adjacent the upper or blind end of the hole 10, the bolt 13 is threaded and engages an anchor 16 which in turn is secured to the walls of the opening. By tightening the bolt 13 by continuing to turn it and, thus, thread it through the anchor 16, the bolt is placed in tension. In accordance with this invention, the tension placed on the bolt is substantially that at which the bolt reaches its elastic limit. Thus, the full load carrying capacity of the bolt is utilized. The upward forces applied by the bolt support the surface rock of the mine roof and transfer these forces to a portion of the rock which is substantially deeper within the rock formation and, therefore, much better equipped to withstand the loads resulting from the removal of support from beneath the surface rock.

Figure 3:
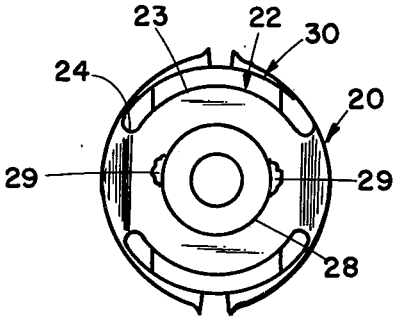
FIG. 3 is a view of the upper end of the anchor member.
Figure 2:
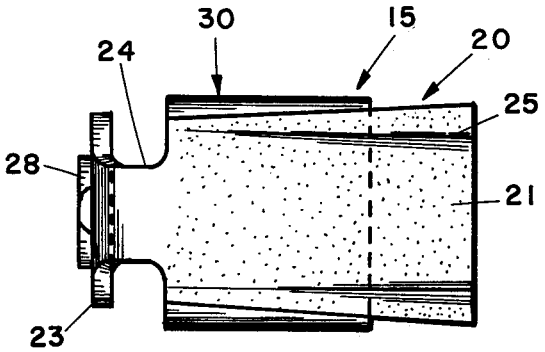
FIG. 2 is a side elevation view of the anchor member.

FIGS. 2, 3, 4, 6 and 8 illustrate the anchor 16. The anchor consists of an outer shell 20 and an expander nut 30. The outer shell, in its preferred form, is formed from a metal stamping of heavy gauge steel such as a cold rolled steel of 3/16 inch thickness. The shell itself consists of a pair of wings 21 joined together at one end by a bridge 22. The bridge 22 has an enlarged, central portion 23 to provide sufficient metal that it will withstand reasonably high loads without distortion or rupturing when the anchor member is installed as will become obvious when the operation of the invention is described. At the upper end of the wings 21, each is integral with the bridge 22 by means of a hingelike section 24 of reduced width as best seen in FIGS. 2 and 3. Because of this hinge-like portion, the wings are able to be pivoted outwardly about these portions into a divergent configuration.

Figure 4:
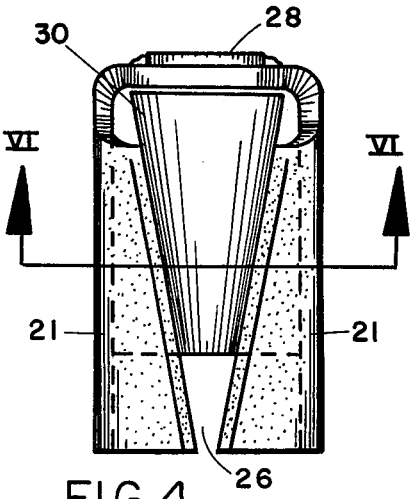
FIG. 4 is a side elevation view of the anchor member illustrating the relationship between the shell and the expander nut prior to expansion of the shell.
Figure 8:
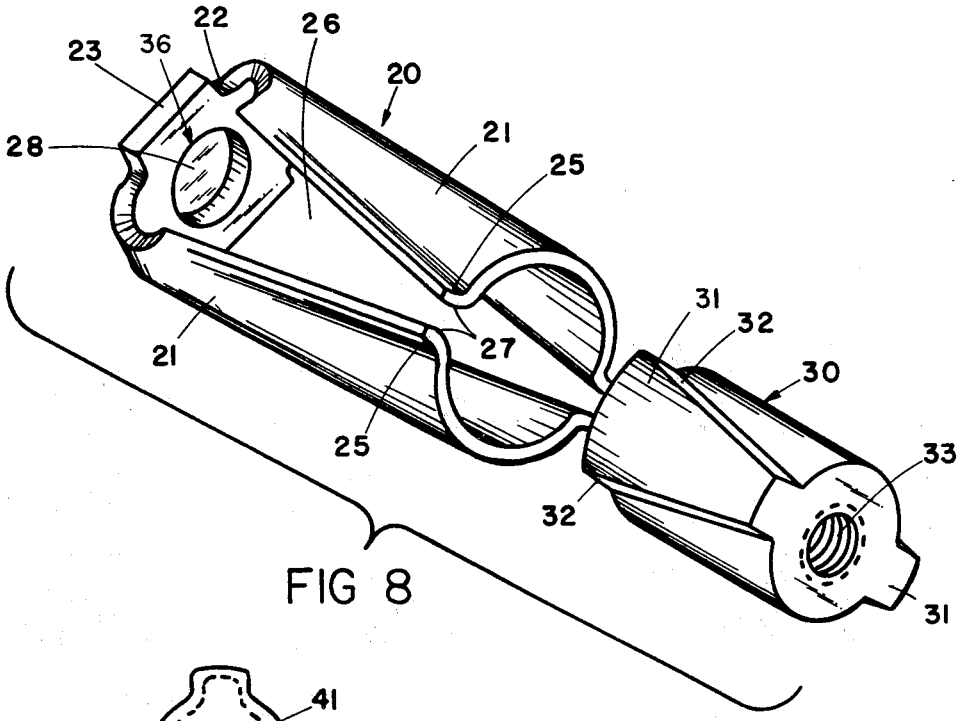
FIG. 8 is an exploded, oblique view of the anchor member.

At the upper end or the end adjacent the bridge portion 22, each of the wings in cross section is substantially a segment of a circle. As the wings progress away from the bridge portion 22, the configuration of the wings goes through a transition of a semi-flattened hat-shape. In so changing shape, a pair of outwardly extending flanges 25 are formed along the edges of the wings. These flanges become wider as they extend further from the bridge portion 22. The gap 26 formed between the flanges is tapered such that the flanges converge as they progress away from the bridge 23 (FIGS. 4 and 8). The facing surfaces 27 of the flanges are coined to smooth them and to harden them so as to form cam surfaces which cooperate with the hereinafter described wedge surfaces of the expander nut.

The central portion of the bridge 23 is provided with a partially severed, knock-out 28. The diameter of the knock-out is such that the opening it leaves, when it is removed, is substantially that of the bolt which will ultimately be used with the anchor member. The opening formed by the knock-out 28 is centered with respect to the shell and the bridge 23. The knock-out remains attached to the bridge by a pair of narrow tabs 29 (FIG. 3).

Trapped within the shell is the expander plug or nut 30. In its preferred embodiment, the expander nut 30 preferably is cast from any suitable steel alloy and consists of a main or central, more or less circular, central portion having a pair of diametrically opposed and outwardly projecting shoulders 31. The shoulders 31 are tapered in a manner to form a pair of camming surfaces 32 which converge lengthwise of the nut away from the bridge 23 of the shell. The angle of convergence of the camming surfaces 32 is such that they are complimentary to the flanges 25 and seat against the coined surfaces 27 of the flanges for substantially the full length of the area where they are adjacent each other. When initially assembled, as best seen in FIG. 4, the nut is seated with one end at or almost at the bridge portion 23 of the shell 20. The nut has a central internally threaded opening 33 to receive the threaded end of the bolt or rod 13. This opening 33 is aligned with the opening 36 which is formed by the removal of the knock-out 28.

The outer surface of the wings 21 are coated with sand grains bonded to the surface by a suitable resin such as a cellulose acetate or an epoxy. A sharp sand is utilized to provide frictional grip. It has been found that the sand and the resin may be mixed prior to application to the surface or the surface may be coated with the resin and before the resin sets, the sand is blown or sifted over the surface so that it will become bonded as the resin sets. The layer of resin is thin and is only enough to provide a bonding means to adhere the sand to the shell.

Unlike prior art devices of this type, in this case the resin is not relied upon for effecting attachment of the anchor to the rock. Thus, only that thin coating of resin necessary to hold the sand in place until the anchor is installed is necessary for the purposes of this invention. When the sand is premixed with the resin, the sand proportion of the mix is high and only a thin layer of the mix is applied so that the sand forms the bridge between the rock and the anchor. It is for this reason that any adhesive capable of holding the sand in place during installation can be utilized.

To lubricate the threaded connection between the rod and the expander nut, it has been found that the application of a coat of polywax to the threading of the rod provides a much preferable lubrication system than more conventional materials such as oil. For example, with the threads lubricated with conventional oil, when 3,000 pounds of tension was applied to the bolt, the torque measured 100–170 foot pounds and at maximum tension which could be obtained with this lubricant, the torque was 180–250 foot pounds and the tension developed was 3,250 to 4,300 pounds. In contrast to this, when polywax was applied to the same device, the torque required to obtain 3,000 pounds tension on the bolt was 15 to 42 pounds and when a torque of 70 to 110 foot pounds was applied, the tension applied to the bolt was 10,500 to 12,000 pounds. The polywax utilized in this case consisted of polyethylene and a crystalline wax.

In addition to application of the polywax to the threads, it has been found to be advantageous to apply the polywax to the coined cam surfaces 27 of the flanges 25. This facilitates the sliding movement of the expander nut 30 and permits a substantially greater, outwardly acting or radially effective expansion force to be applied before any galling between the coined surfaces 27 of the shell and the wedge surfaces 32 of the expander nut occurs. Thus, an even greater proportion of the tension pull applied to the nut by the bolt is translated into sideways acting pressure and, thus, into bearing with the side walls of the opening.

Figure 11:
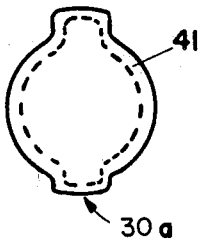
FIG. 11 is an end elevation view of the structure illustrated in FIG. 10.
Figure 9:
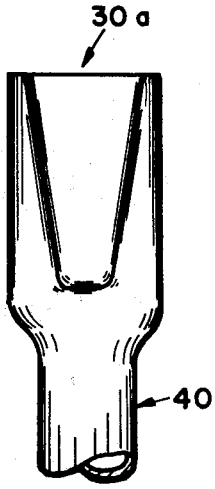
FIG. 9 is an end elevation view of a modified form of this invention.
Figure 10:
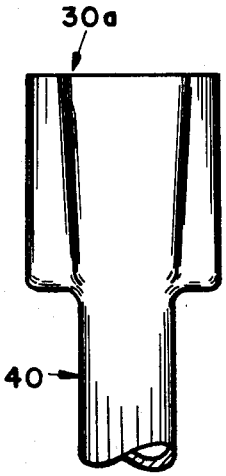
FIG. 10 is a side elevation view of the structure illustrated in FIG. 9.

FIGS. 9, 10 and 11 illustrate a modified form of the invention wherein the expander plug or nut 30*a* is formed from tubular material rather than fabricated as a casting. It may be formed as a head portion on the end of a tube 40. The end of the tube is closed by a cap 41 as indicated in FIG. 11. While the cap is necessary only in those cases in which an epoxy resin is used and mixed in the installation of the anchor member to prevent the resin from being wasted by escaping through the center of the tube, it is also desirable to support the walls of the tube. In the case of the tubular expander nut 30*a*, the same shell 20 is utilized. The shape of the expander nut 30*a* is such that it has the same cooperation with the shell and when withdrawn downwardly from the joined end of the shell, results in outward expansion of the wings of the shell to engage the walls of the opening. The expander nut 30*a* is designed for somewhat lighter service than the expander nut 21 because, being tubular, it is subject to inward deflection under very high wedging loads. Its capacity is increased by proper heat treating.

The tube 40 may be short and internally threaded to receive the threaded end of a rod or it may extend the full length of the hole and have means at the opposite end for applying tension and shifting it lengthwise to force the wings of the shell to expand.

Figure 5:
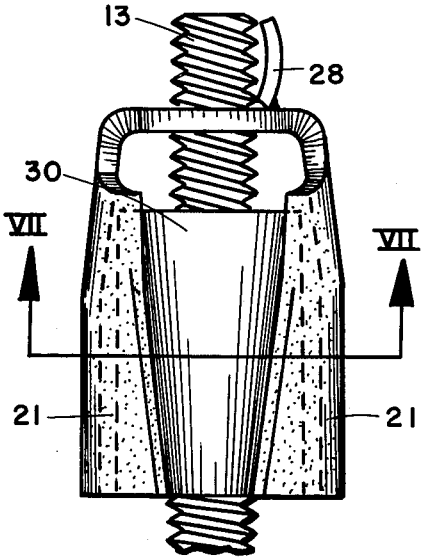
FIG. 5 is a side elevation view of the anchor member after the shell has been substantially, fully expanded.
Figure 7:
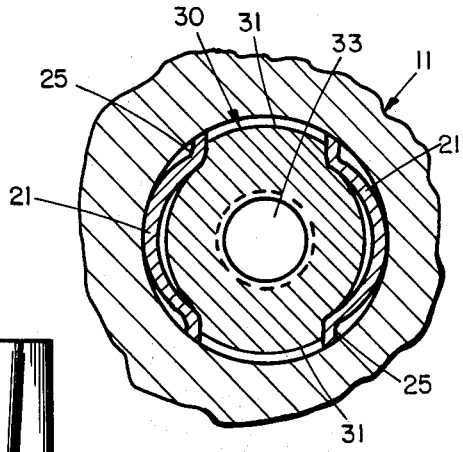
FIG. 7 is a sectional view taken along the plane VII—VII of FIG. 5.

Utilizing the invention to provide a mine roof support, the hole is first bored to an adequate depth dependent upon the nature of the rock, usually over three feet. In the case of the form of the invention shown in FIGS. 1–8, the anchor member 16 is threaded on the end of a rod 13 with the rod threaded through the expander nut 30 until it almost or just touches the knockout cap 28. The wings 21 of the shell as initially inserted are slightly spread so that the lower or free ends of the wings scrape along the walls of the hole 10 as the anchor member is inserted in the hole to the full depth of the rod. At this point, the bearing plate 15 which had been placed on the rod before the anchor member 16 was attached, seats against the face of the mine roof and the rod is turned by the head 14 on its end. Because there is a frictional interference between the ends of the wings 21 and the walls of the hole 10, the shell 20 is held against turning and, thus, as the turning of the bolt continues, the wedge is pulled downwardly, forcing the wings outwardly. Because the threads of the bolt are lubricated, the tendency of the nut to turn is materially reduced. Thus, the amount of initial interference between the shell and walls necessary to hold the nut can be relatively small. Because the angle at which the expander nut and the wings engage, very high outward components of force are generated as the expansion nut moves downwardly. In fact, these forces are so great that the wings 21 of the shell 20 are flattened against the walls of the hole and this flattening effect progresses upwardly along the wings as the expander nut is pulled further and further down. This is illustrated in FIG. 5 wherein the entire lower portions of the wings are illustrated as flattened against the walls of the opening. This forces the resin/sand into intimate contact with the rock with the sand pressed against the rock under very high pressure. At the same time, as indicated by the cross-sectional shape of the shell illustrated in FIG. 7, the arch of the shell is partially crushed or collapsed, increasing the area of bearing with the walls of the opening. The outer edges of the flanges 25 are spread outwardly to press against the walls of the hole. Thereby, there is created a toggle of increasing reactive force as the expander nut is moved away from end 28. Thus, there is created high resistance to further collapse of the arch coupled with a degree of springback urging the central portion of the arch outwardly. This combination provides a very high, permanent, outwardly acting bearing force to assure positive engagement between the anchor member and the walls of the opening.

Because the threads of the bolt are polywax coated, the friction between the threads of the bolt and the threading of the nut is substantially reduced. Thus, a substantial portion of the forces applied to the bolt in torque are translated into outward or lateral forces applied by the expander nut to the wings of the shell. In addition, since the surfaces of the expander nut and the cooperating flanges of the wings of the expander nut are also lubricated, the frictional forces resisting movement of the nut are substantially reduced, again increasing the proportion of the torque applied to the bolt which is effectively translated into outward expansive forces generating bearing with the rock walls of the hole. Because of these factors, this invention provides an anchor which, with only a few inches in bearing with the walls of the opening, is capable of providing an anchor which will remain stable in either soft or hard rock under loads which approach the elastic limit of the bolts. Thus, extremely high loadings are possible for this type of roof anchor. Tests have established that a shell of 3/16 inch cold rolled steel having wings of $2\frac{1}{4}$ inches long and of $1\frac{3}{8}$ inch diameter initially at its lower or free end installed in a $1\frac{3}{8}$ inch diameter opening in hard rock was capable of being loaded to 30,000 pounds in tension. This permits the bolts to be prestressed to their elastic limit. Since the anchor is stable and the bolts are loaded to a point where they do not have a tendency to loosen and do not shift their load to other bolts, a highly effective and dependable roof support is provided.

As illustrated in FIG. 5, the ends of the bolt as it was turned up through the nut presses against the knock-out 28. Initially, the knock-out resists movement and, thus, even though the end of the bolt is pressing firmly against the knock-out, this upward force of the bolt is applied to the shell, forcing the shell to work against the wedge to increase quickly the frictional engagement between the shell and the walls of the hole. This assures a firm anchoring of the shell against rotation even though the torsional forces become high as a result of the torque applied to the bolt.

However, the knock-out 28 being partially weakened, ultimately breaks away on one side under the increasing pressure of the bolt and is pivoted upwardly to permit the bolt to pass on through as indicated in FIG. 5. Because of the resistance of the knock-out to this type of movement, a metallic interference is created between the threads of the bolt and the knock-out which is maintained throughout the remaining movement of the bolt. The diameter of the hole left by the knock-out is designed and dimensioned to be a tight fit for the bolt. This creates a situation which resists any tendency of the shell to tip or skew and, thus, become misaligned.

It will be recognized that while I have disclosed a preferred embodiment of my invention, various modifications of the invention can be made without departing from the principles of this invention. Such modifications are to be considered as included in the hereinafter appended claims unless the claims, by their language, expressly state otherwise.

The embodiments of the invention in which an exclusive property or privilege is claimed are defined as follows:

1. In means for securing a bolt in a generally circular hole formed in a rigid material such a rock, said means comprising: a shell and an expander nut, said shell having a pair of wings joined at one end, said wings each having a primary central body portion of outwardly arched cross-sectional shape and a generally smooth exterior surface, a pair of flanges, one on each side, extending generally diametrically outwardly from each of said wings; the surfaces of said flanges being opposed and forming cam surfaces converging away from said joined end, said expander nut having wedge surfaces complimentary to and seated against said cam surfaces for urging said wings apart when said expander nut is moved away from said joined end; the walls of said nut being spaced from the interior surfaces of said wings between said flanges; the edges of said flanges and the crown of said central body portion of each wing forming a toggle of increasing reactive force as said expander nut is moved away from said joined end.

2. In means for securing a bolt as described in claim 1 wherein said expander nut has diametrically positioned projections, each of said projections having a pair of converging shoulders forming said wedge surfaces.

3. In means for securing a bolt as described in claim 1 wherein each of said flanges is of increasing width away from said joined end.

4. In means for securing a bolt as described in claim 3 wherein each of said wings adjacent its end opposite from said one end has a cross-sectional shape between said flanges substantially that of a partially flattened arch whereby said flanges are forced diametrically outwardly under radial compressive forces acting on said wings intermediate of said flanges.

5. In means for securing a bolt as described in claim 1 wherein said wings of said shell are divergent away from said joined end at a very small angle just sufficient to cause the free ends of said wings to engage the walls of the hole into which it is inserted.

6. In means for securing a bolt as described in claim 1 wherein the outer surface of said shell is coated with sharp sand adhesively bonded thereto.

7. A method of securing a mine roof support bolt in a hole including the steps of providing an anchor member for the bolt, the anchor member having a longitudinally bifurcated body of generally circular shape having generally diametrically extending projections on each portion; coating the exterior surface of the anchor member with sharp sand and bonding the same thereto with a resin, seating the anchor member at the blind end of a hole in the mine roof, applying pressure to each portion at its edges only to force the portions apart and expand the anchor member against the walls of the hole to create an area of bearing between the body and the walls of the hole wherein the sand is pressed firmly against the walls of the hole and by said outwardly acting force partially collapsing the halves of the body to force the projections radially and create a toggle-like reaction force urging the projections and the central portion of the body halves therebetween into lateral engagement with walls of the hole.

8. A support bolt for mine roofs adapted to be inserted in a generally circular hole formed in the roof, said support bolt comprising: a shell and an expander nut, said shell having a pair of wings joined at one end, each of said wings adjacent said joined end having a cross-sectional shape substantially that of a segment of a circle and at the opposite end having an outwardly arched central portion flanked on each side by an outwardly extending flange; said wings between said flanges having smooth surfaces; said flanges on the opposite sides of each wing lying in the same general plane and forming cam surfaces converging away from said joined end, said expander nut having wedge surfaces complimentary to and seated against said cam surfaces for urging said wings apart when said expander nut is moved away from said joined end; said nut being spaced from said wings between said flanges; means for attaching an element to said expander nut for forcibly moving said expander nut away from said joined end and partially flattening the arched portion of said wings, forcing the edges of said flanges diametrically outwardly to form a toggle of increasing reactive force as said expander nut is moved away from said joined end; elongated means secured to said nut and having a length substantially equal to that of the hole, a bearing member surrounding said elongated means at the end thereof opposite from said nut; said rod being adapted to apply tension to said expander nut for moving it away from said joined end of said shell and expanding said shell against the walls of said hole.

9. A roof support bolt as described in claim 8 wherein the exterior surface of said shell is coated with sand adhesively bonded thereto.

10. A roof support bolt as described in claim 8 wherein said wings of said shell as said shell is initially introduced into the hole are sufficiently divergent that their ends opposite from the joined end frictionally engage the walls of the hole to hold said shell against rotation.

11. In means for securing a bolt in a generally circular hole formed in rigid material such as rock, said means comprising: a shell and an expander nut, said shell having a pair of wings joined at one end, each of said wings adjacent said joined end having a cross-sectional shape substantially that of a segment of a circle and at the opposite end having an outwardly arched central portion flanked on each side by an outwardly extending flange; said wings between said flanges having smooth surfaces; said flanges on the opposite sides of each wing lying in the same general plane and forming cam surfaces converging away from said joined end, said expander nut having wedge surfaces complimentary to and seated against said cam surfaces for urging said wings apart when said expander nut is moved away from said joined end; the walls of said nut being spaced from the interior surfaces of said wings between said flanges; means for attaching an element to said expander nut for forcibly moving said expander nut away from said joined end; the edges of said flanges and the crown of the arched portion of each wing forming a toggle of increasing reaction force as said expander nut is moved away from said joined end.

* * * * *